US006925685B2

(12) United States Patent
Chen

(10) Patent No.: US 6,925,685 B2
(45) Date of Patent: Aug. 9, 2005

(54) ANGULAR ADJUSTMENT ARRANGEMENT OF PIVOT HINGE

(76) Inventor: Mei Li Chen, 316 W. Naomi Ave., Arcadia, CA (US) 91007

( * ) Notice: Subject to any disclaimer, the term of this patent is extended or adjusted under 35 U.S.C. 154(b) by 67 days.

(21) Appl. No.: 10/658,153

(22) Filed: Sep. 8, 2003

(65) Prior Publication Data

US 2005/0050685 A1 Mar. 10, 2005

(51) Int. Cl.[7] ..... E05D 11/10; E05D 7/06

(52) U.S. Cl. ..... 16/332; 16/252; 16/239; 16/241; 16/382; 49/388

(58) Field of Search ..... 166/332, 252, 166/235, 239, 241, 242, 229–231, 262–263, 166/382; 4/557, 607, 610, 612, 614; 49/397–399, 49/381–383, 388; 160/199, 210, 213, 206

(56) References Cited

U.S. PATENT DOCUMENTS

| | | | | | |
|---|---|---|---|---|---|
| 2,781,542 | A * | 2/1957 | West | 16/236 |
| 3,555,733 | A * | 1/1971 | Horgan, Jr. | 49/388 |
| 3,646,635 | A * | 3/1972 | Stermac | 16/239 |
| 3,828,394 | A * | 8/1974 | Horgan, Jr. | 16/241 |
| 4,386,646 | A * | 6/1983 | Matyas | 160/206 |
| 4,689,853 | A * | 9/1987 | Marinoni | 16/382 |
| 4,977,642 | A * | 12/1990 | Marinoni | 16/257 |
| 5,483,770 | A * | 1/1996 | Marinoni | 49/388 |
| 5,548,869 | A * | 8/1996 | Ryczek | 16/93 R |
| 5,613,276 | A * | 3/1997 | Franz | 16/229 |
| 6,161,255 | A * | 12/2000 | Garrett | 16/284 |
| 6,519,811 | B1 * | 2/2003 | Cheng | 16/252 |
| 6,609,335 | B1 * | 8/2003 | Hyakkoku | 49/388 |
| 2004/0020130 | A1 * | 2/2004 | Chiang | 49/388 |

FOREIGN PATENT DOCUMENTS

| | | | | |
|---|---|---|---|---|
| DE | 4319422 C1 * | 8/1994 | | E05D 3/02 |
| EP | 111018 A1 * | 6/1984 | | E05D 7/04 |
| EP | 599255 A1 * | 6/1994 | | E05D 11/10 |

* cited by examiner

*Primary Examiner*—Chuck Y. Mah
(74) *Attorney, Agent, or Firm*—Raymond Y. Chan; David and Raymond

(57) ABSTRACT

A pivot hinge for pivotally mounting a glass structure to a border frame, includes a joint body having two joint walls for securely sandwiching the glass structure, a joint hub including a supporting shaft having an adjusting portion, and an angular adjustment arrangement including a joint seat, having an adjustment sleeve, adapted for securely mounting to the border frame, wherein the adjusting portion of the supporting shaft is rotatably inserted into the adjustment sleeve in such a manner that the joint body is adapted to angularly move with respect to the joint seat for adjustably aligning the glass structure with the border frame and an angular adjustment locker securely lock up the supporting shaft within the adjustment sleeve in a rotatably movable manner for retaining an alignment of the glass structure in position with the border frame so as to pivotally mount the glass structure to the border frame.

20 Claims, 5 Drawing Sheets

ANGULAR ADJUSTMENT ARRANGEMENT OF PIVOT HINGE

BACKGROUND OF THE PRESENT INVENTION

1. Field of Invention

The present invention relates to a pivot hinge assembly for a glass structure, and more particularly to a pivot hinge for a glass structure, which comprises an angular adjustment arrangement adapted to selectively adjust an angular position of the glass structure so as to finely align the glass structure with the border frame.

2. Description of Related Arts

A pivot hinge assembly normally used for pivotally mounting a glass door to a door frame, wherein the pivot hinge assembly comprises a top pivot hinge pivotally mounted at a top edge of the glass door to the door frame and a bottom pivot hinge pivotally mounted at a bottom edge of the glass door to the door frame. However, such pivot hinge assembly has several drawbacks.

Each of the top and bottom pivot hinge generally comprises two cover walls to securely sandwich an edge portion of the glass door and a pivot joint rotatably mounted between the cover walls to securely affix to the door frame such that the glass door is pivotally mounted within the door frame via the pivot hinges. However, in order to adjustably align the glass door with respect to the door frame, the glass door must be unlocked from the cover walls of each of the pivot hinges such that the glass door can be angularly moved with respect to the cover walls to alignedly fit the door frame. It is worth to mention that when the glass door is misalignedly mounted to the door frame, the ornamental appearance of the glass door will be destroyed or even the glass door cannot be closed. In other words, the configuration of the glass door is too complicated that a skilled technician is required for the installation.

In addition, the relatively heavy weight of the glass door and the pivot movement thereof will cause the glass door to misalign with the door frame after a period of time. However, the user is not able to self adjust the alignment of the glass door. Therefore, the user must call the technician to fix the alignment of the glass door which will highly increase the maintenance cost of the glass door.

Furthermore, the structures between the top pivot hinge and the bottom pivot hinge are different, the pivot hinges cannot be applied to both the top and bottom edges of the glass door. Therefore, the manufacturer must manufactures both the top and bottom pivot hinges as a pair so as to increase the manufacturing cost of the pivot hinge assembly.

Thus, the pivot joint comprises a supporting shaft having a threaded portion arranged rotatably screwed into a screw hole on a frame track of the door frame. However, the engagement between the supporting shaft and the frame track is relatively weak due to the limited thickness of the frame track. It is costly to increase the thickness of the entire frame track to strengthen the engagement of the pivot joint and the overall weight of the glass door will be substantially increased which may damage the structure of the door frame.

SUMMARY OF THE PRESENT INVENTION

A main object of the present invention is to provide a pivot hinge for a glass structure, which comprises an angular adjustment arrangement adapted to selectively adjust an angular position of the glass structure so as to finely align the glass structure with the border frame.

Another object of the present invention is to provide a pivot hinge for a glass structure, wherein the glass structure does not require to be unlocked or released from the angular adjustment arrangement in order to align with the border frame. In other words, the aligning operation is easy and simple that an individual is able to self-adjust the glass structure to align with the border frame, so as to minimize the maintenance cost of the glass structure.

Another object of the present invention is to provide a pivot hinge for a glass structure, wherein the pivot hinge is a universal hinge structure adapted to mount at the right, left, top, or bottom edge portion of the glass structure so as to minimize the manufacturing cost of the pivot hinge of the present invention in comparison with the conventional pivot hinge that must be made in pair.

Another object of the present invention is to provide a pivot hinge for a glass structure, wherein the pivot hinge further comprises a reinforcing member mounted at the frame track to increase the thickness thereof so as to enhance the strength of the frame track. Therefore, the engagement between the pivot hinge and the border frame can be substantially strengthened without altering the original structure of the frame track.

Another object of the present invention is to provide a pivot hinge for a glass structure, wherein no expensive or complicated structure is required to employ in the present invention in order to achieve the above mentioned objects. Therefore, the present invention successfully provides an economic and effective solution not only for providing a rigid configuration to securely mount the glass structure within the border frame but also for enhancing the angular adjustment of the glass structure to align with the border frame.

Accordingly, in order to accomplish the above objects, the present invention provides a pivot hinge for pivotally mounting a glass structure to a border frame, comprising:

a joint body comprising two spaced apart joint walls defining a securing cavity therebetween for securely sandwiching an edge portion of the glass structure between the joint walls;

a joint hub comprising a joint housing securely mounted between the joint walls within the securing cavity and a supporting shaft having a control portion rotatably extended from the joint housing and an adjusting portion extended out of the securing cavity, and an angular adjustment arrangement, comprising:

a joint seat, having an adjustment sleeve, adapted for securely mounting to the border frame, wherein the adjusting portion of the supporting shaft is rotatably inserted into the adjustment sleeve in such a manner that the joint body is adapted to angularly move with respect to the joint seat for adjustably aligning the glass structure with respect to the border frame; and an angular adjustment locker provided at an outer side of the joint seat to securely lock up the supporting shaft within the adjustment sleeve in a rotatably movable manner for retaining an alignment of the glass structure in position with respect to the border frame so as to pivotally mount the glass structure to the border frame.

These and other objectives, features, and advantages of the present invention will become apparent from the following detailed description, the accompanying drawings, and the appended claims.

DETAILED DESCRIPTION OF THE PREFERRED EMBODIMENT

Figure 1:
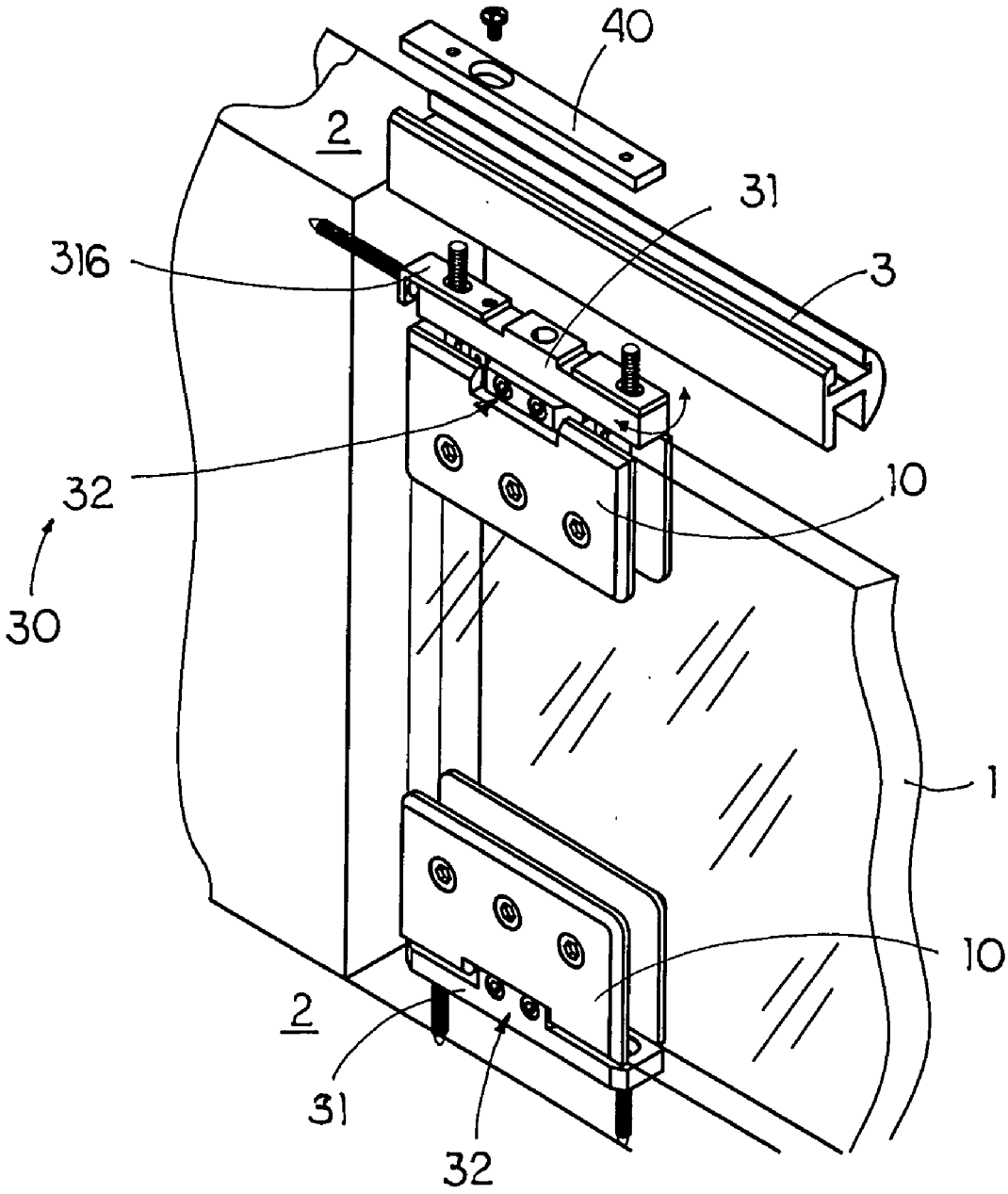
FIG. 1 is a perspective view of a pivot hinge for pivotally mounting a glass structure to a border frame according to a preferred embodiment of the present invention.
Figure 2:
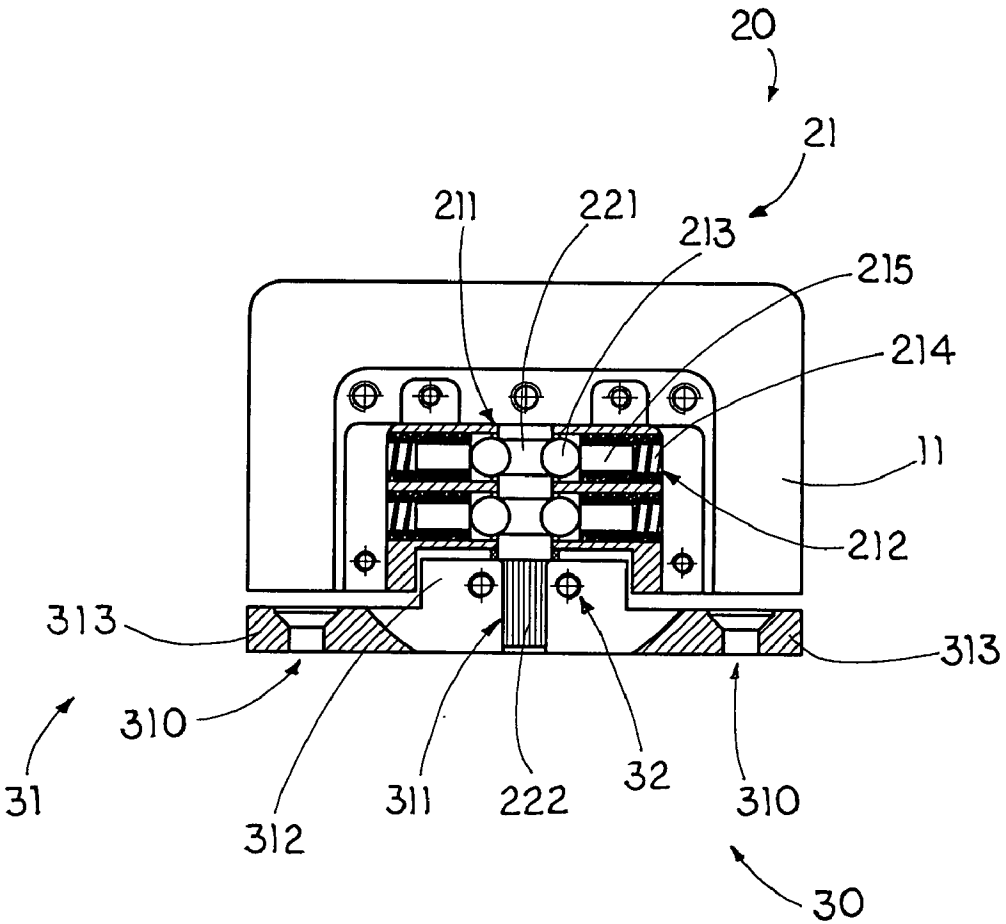
FIG. 2 is a sectional view of the pivot hinge according to the above preferred embodiment of the present invention.
Figure 3:
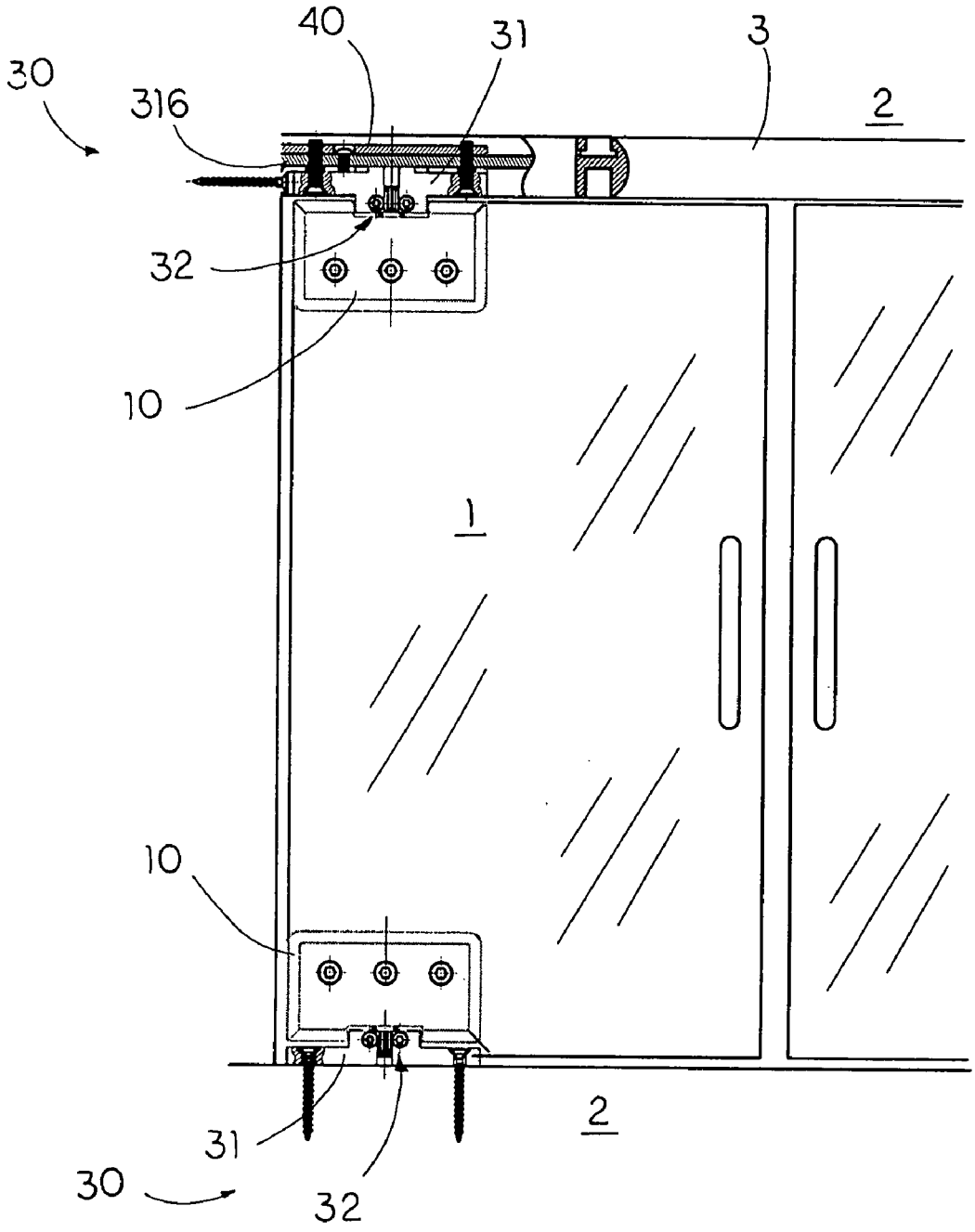
FIG. 3 is a partially sectional view of the pivot hinge according to the above preferred embodiment of the present invention, illustrating the glass structure being pivotally mounted within the border frame.

Referring to FIGS. 1 to 3 of the drawings, a pivot hinge for pivotally mounting a glass structure 1 to a border frame 2 according to a preferred embodiment of the present invention is illustrated, wherein the pivot hinge comprises a joint body 10, a joint hub 20 and an angular adjustment arrangement 30.

As shown in FIGS. 1 and 3, the glass structure 1 is embodied as a glass door pivotally mounted to a door frame as the border frame 2 via the pivot hinge of the present invention. It is worth to mention that the glass structure 1 can be a glass window pivotally mounted to a window frame as the border frame 2.

The joint body 10 comprises two spaced apart joint walls 11 defining a securing cavity 101 therebetween for securely sandwiching an edge portion of the glass structure 1 between the joint walls 11.

The joint hub 20 comprises a joint housing 21 securely mounted between the joint walls 11 within the securing cavity 101 and a supporting shaft 22 having a control portion 221 rotatably extended from the joint housing 21 and an adjusting portion 222 extended out of the securing cavity 101.

The angular adjustment arrangement 30 comprises a joint seat 31 adapted for securely mounting to the border frame, and an angular adjustment locker 32.

The joint seat 31 has an adjustment sleeve 311 wherein the adjusting portion 222 of the supporting shaft 22 is rotatably inserted into the adjustment sleeve 311 in such a manner that the joint body 10 is adapted to angularly move with respect to the joint seat 31 for adjustably aligning the glass structure 1 with respect to the border frame 2.

The angular adjustment locker 32 is provided at an outer side of the joint seat 31 to securely lock up the supporting shaft 22 within the adjustment sleeve 311 for retaining an alignment of the glass structure 1 in position with respect to the border frame 2 so as to pivotally mount the glass structure 1 to the border frame 2.

Figure 4:
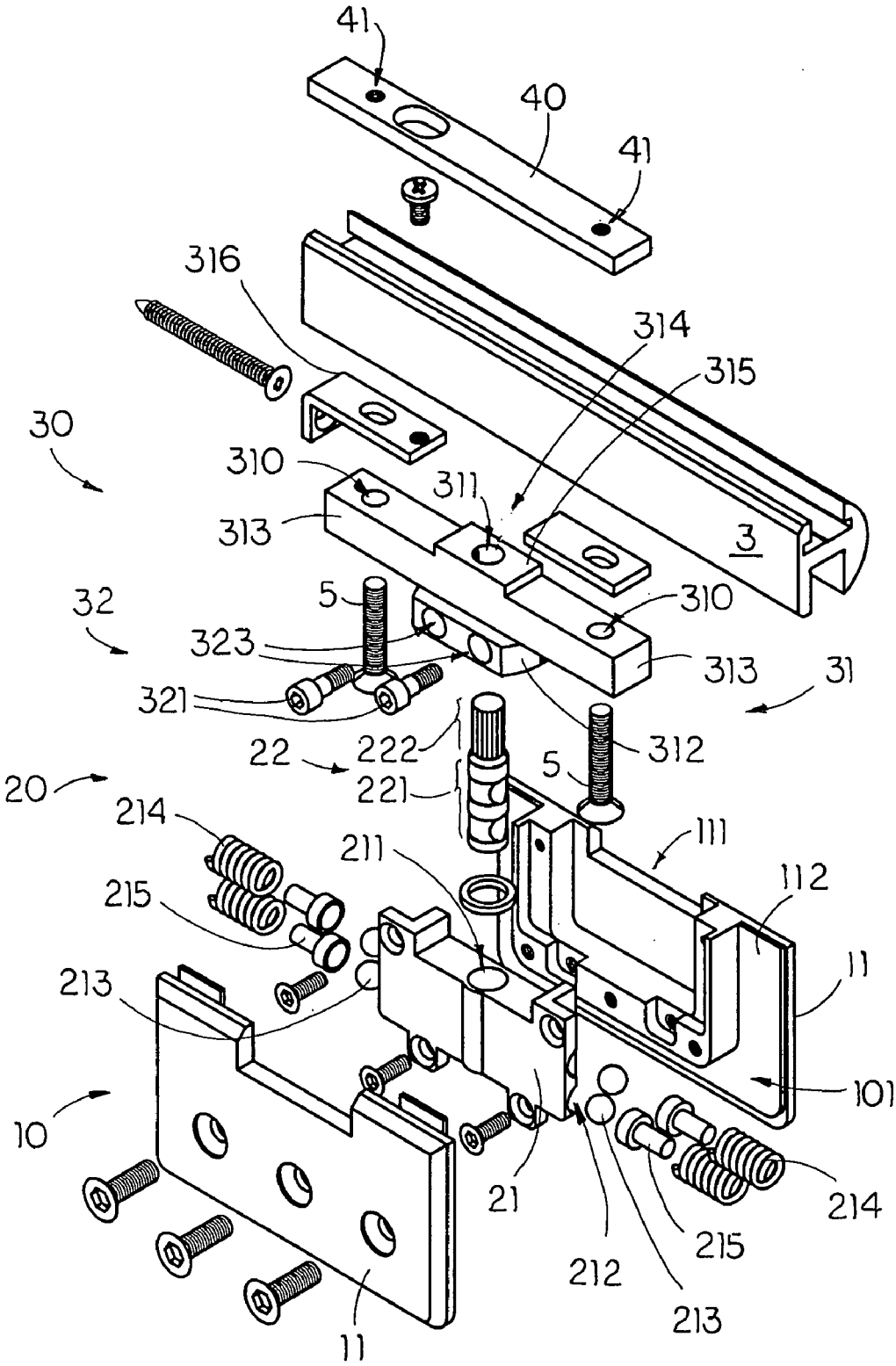
FIG. 4 is an exploded perspective view of the pivot hinge as a top hinge according to the above preferred embodiment of the present invention.
Figure 5:
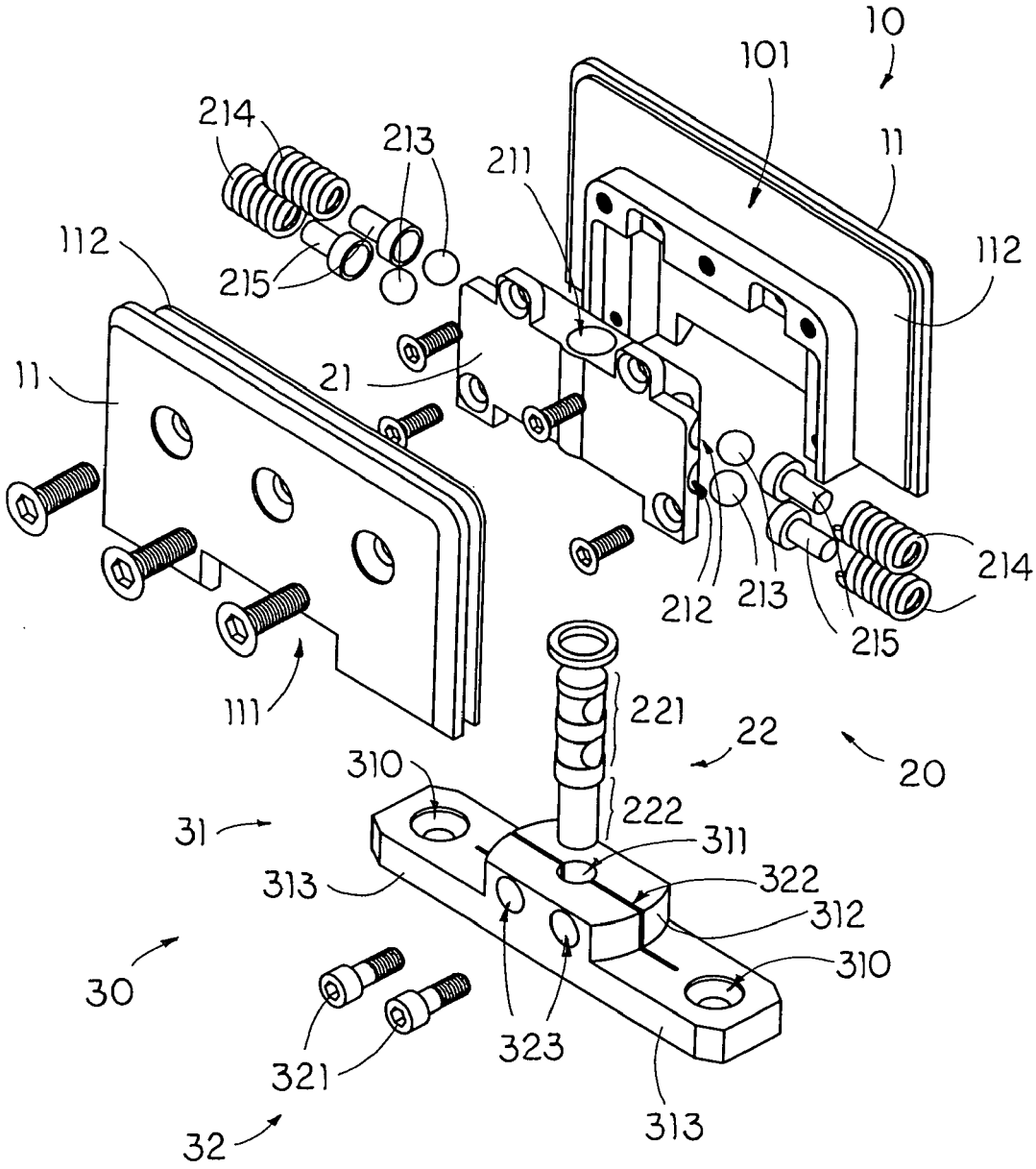
FIG. 5 is an exploded perspective view of the pivot hinge as a bottom hinge according to the above preferred embodiment of the present invention.

According to the preferred embodiment, the pivot hinge is embodied as a top pivot hinge to mount on a top edge portion of the glass structure 1 as shown in FIG. 4. In addition, the pivot hinge is embodied as a top pivot hinge to mount on a bottom portion of the glass structure 1 as shown in FIG. 5. It is worth to mention that the difference between the top and pivot hinges is that the top pivot hinge is mounted to a frame track of the border frame 2 and the bottom pivot hinge is directly mounted to the border frame 2.

The joint body 10 is adapted for securely mounting at a top or bottom edge portion of the glass structure 1 by sandwiching the edge portion of the glass structure between the joint walls 11. Each of the joint walls 11, having a U-shaped, defines an accessing cavity 111 to communicate with the joint seat 31. Each of the joint walls 11 further comprises a cushion layer 112 attached to an inner side thereof for frictionally contacting with the glass structure 1 so as to not only substantially hold the glass structure 1 within the securing cavity 101 but also prevent the glass from being scratched when the joint walls 11 press thereon.

As shown in FIG. 4, the joint housing 21, which is securely mounted between the joint walls 11, has an axial sleeve 211 to rotatably receive the control portion 221 of the supporting shaft 22 and at least two radial slots 212 radially extended to communicate with the axial sleeve 211, wherein the joint housing 21 further comprises at least two driving members 213 rotatably disposed within the radial slots 212 respectively to ensure the supporting shaft 22 in a rotatably movable manner within the axial sleeve 211.

Accordingly, each of the driving members 213 is a ball shaped bearing member rotatably disposed within the respective radial slots 212 to contact with the control portion 221 of the supporting shaft 22 so as to ensure the rotational movement of the supporting shaft 22 within the axial sleeve 211 by reducing the friction therebetween.

The joint housing 21 further comprises at least two resilient members 214 disposed within the radial slots 212 respectively for applying an urging pressure against the driving members 213 to bias against the control portion 221 of the supporting shaft 22. Each of the resilient members 214 is a compression spring having two ends biasing against the respective driving member 213 and an inner wall of the joint housing 21 to push the driving member 213 towards the supporting shaft 22. In addition, at least two driving holders 215 are respectively mounted between the resilient members 214 and the driving members 213 to hold the driving members 213 in position within the radial slots 212 respectively.

As shown in FIGS. 1 and 4, the joint seat 31 is mounted at a frame track 3 of the border frame 2 as the pivot hinge is embodied as the top pivot hinge such that when the joint body 10 is rotatably engaged with the joint seat 31 through the supporting shaft 22, the glass structure 1 is pivotally mounted within the border frame 2.

The joint seat 31, having a T-shaped, comprises a central platform 312 defining the adjustment sleeve 311 thereon and two side platforms 313 for securely attaching to the border frame 2, wherein the central platform 312 is disposed within the accessing cavity 111 of the joint body 10 to rotatably engage the adjusting portion 222 of the supporting shaft 22 with the adjustment sleeve 311. It is worth to mention that the joint walls 11 are configured to have a U-shape to reduce the overall weight of the joint body 10 so as to minimize the manufacturing cost of the pivot hinge and to prevent the glass structure 1 from being misaligned with the border frame 2.

As shown in FIG. 4, the joint seat 31 further has a frame mounting surface 314 for mounting on the border frame 2 and comprises a leveling platform 315 integrally extended from a mid-portion of the frame mounting surface 314 and a level adjusting member 316, having the same thickness of the leveling platform 315, detachably mounted on a side of the leveling platform 315 to level the frame mounting surface 314. It is worth to mention that the conventional pivot hinge can only fit for either the right or left side of the glass structure 1 such that the manufacturer must manufacture the pivot hinge in pair.

According to the preferred embodiment, the joint seat 31, which is embodied as a universal joint, is adapted for mounting to the right or left side of the glass structure 1 by arranging the location of the leveling platform 315. Therefore, the level adjusting member 316 is adapted to selectively place to one side of the leveling platform 315 to level the frame mounting surface 314 for fittingly mounting on the border frame 2. In other words, when the pivot hinge of the present invention is arranged to mount to the top right edge portion of the glass structure 1 with the border frame 2, the user is able to place the level adjusting member 216 at the corresponding side of the leveling platform 315 to form the flat frame mounting surface 314 of the joint seat 31 so as to substantially mount on the border frame 2, as shown in FIG. 1.

As shown in FIGS. 4 and 5, the angular adjustment locker 32 comprises at least a locking member 321 and has an adjustment slit 322 longitudinally formed on the joint seat 31 to communicate with the adjustment sleeve 311 and at least a locking hole 323 transversely formed on the outer side of the joint seat 31 though the adjustment slit 322, wherein the locking member 321 is rotatably engaged with the locking hole 323 to adjustably reduce a width of the adjustment slit 322 so as to lock up the adjusting portion 222 of the supporting shaft 22 within the adjustment sleeve 311.

The adjustment slit 322 is longitudinally formed along the central platform 312 of the joint seat 31 across the adjustment sleeve 311 and the locking hole 323 is transversely formed on the outer side of the central platform 312 through the adjustment slit 322 such that a size of the adjustment sleeve 311 is substantially reduce to frictionally lock up the adjusting portion 222 of the supporting shaft 22 when the locking member 321 is rotatably engaged with the locking hole 323 to reduce the width of the adjustment slit 322.

In other words, a width of the adjustment sleeve 311 is arranged to be adjustably reduced via the locking member 321 such that an inner circumferential surface of the adjustment sleeve 311 is frictionally biased against an circumferential surface of the adjusting portion 222 of the supporting shaft 22 so as to securely lock up the adjusting portion 222 of the supporting shaft 22 within the adjustment sleeve 311. Preferably, the adjusting portion 222 of the supporting shaft 22 is constructed to have a cog-liked cross section to frictionally engage with the adjustment sleeve 311, so as to ensure the supporting shaft 22 locking up with the joint seat 31. It is worth to mention that when the adjusting portion 222 of the supporting shaft 22 is locked up with the joint seat 31 via the angular adjustment locker 32, the supporting shaft 22 can only be rotated with respect to the joint body 10 via the joint housing 21.

Therefore, when the joint body 10 and the joint seat 31 are respectively mounted to the glass structure 1 and the border frame 2, the adjustment portion 222 of the supporting shaft 22 is rotatably inserted into the adjustment sleeve 311 to rotatably engage the joint body 10 with the joint seat 31 such that the user is able to align the glass structure 1 with the border frame 2 by angularly turning the joint body 10 with respect to the joint seat 31. Once the glass structure 1 is aligned with the border frame 3, the user is able to lock up the supporting shaft 22 within the adjustment sleeve 311 via the angular adjustment locker 32 so as to retain the alignment of the glass structure 1 with respect to the border frame 2.

It is worth to mention that the locking hole 323 is formed on the outer side of the joint seat 31 such that the user is able to easily screw the locking member 321 into the locking hole 323 without disassembling the joint seat 31 from the border frame 2. In addition, once the alignment of the glass structure 1 is off from the border frame 2, the user is able to self-adjust the glass structure 1 to align with the border frame 2 by only unlocking and re-locking the angular adjustment locker 32, so as to minimize the maintenance cost of the glass structure 1.

Alternatively, the locking hole 323 can be formed on the outer side of the joint seat 31 to communicate with the adjustment sleeve 311 such that the locking member 321 is adapted to rotatably engage with the locking hole 323 to directly lock up the adjusting portion 222 of the supporting shaft 22 within the adjustment sleeve 311.

In order to securely mount the joint seat 31 to the frame track 3 of the border frame 2, the joint seat 31 has two securing holes 310 respectively provided at the side platforms 313 for aligning with two mounting holes 4 formed on the frame track 3 respectively such that by screwing two attaching elements 5, such as screws, to the mounting holes 4 through the securing holes 310 respectively, the joint seat 31 is mounted at the frame track 3 of the border frame 2.

As shown in FIG. 4, the pivot hinge further comprises a reinforcing member 40 adapted for mounting on the frame track 3 of the border frame 2 to strengthen the frame track 3 by increasing a thickness thereof, wherein the joint seat 31 is securely mounted to the reinforcing member 40 for substantially sandwiching the frame track 3 therebetween so as to rigidly mount the joint seat 31 to the border frame 2. The reinforcing member 40 has two reinforcing holes 41 respectively aligning with the securing holes 310 of the joint seat 31 such that the frame track 3 is securely sandwiched between the joint seat 31 and the reinforcing member 40 via the attaching elements 5.

As it is mentioned in the background, the joint seat 31 can be securely mounted to the frame track 3 depending on the thickness thereof. Therefore, the reinforcing member 40 can substantially increase the thickness of the frame track 3 to strengthen the portion of the frame track 3 with respect to the joint seat 31. It is worth to mention that the reinforcing member 40 ensure the secure connection between the joint seat 31 and the frame track 3 without increasing its entire thickness to enhance the strength thereof.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A pivot hinge for pivotally mounting a glass structure to a border frame, comprising:

a joint body comprising two spaced apart joint walls defining a securing cavity therebetween for securely sandwiching an edge portion of said glass structure between said joint walls;

a joint hub comprising a joint housing securely mounted between said joint walls within said securing cavity and a supporting shaft having a control portion rotatably extended from said joint housing and an adjusting portion extended out of said securing cavity, and an angular adjustment arrangement, comprising:

a joint seat, having an adjustment sleeve, adapted for securely mounting to said border frame, wherein said adjusting portion of said supporting shaft is rotatably inserted into said adjustment sleeve in such a manner that said joint body is adapted to angularly move with respect to said joint seat in a rotatably movable manner for adjustably aligning said glass structure with respect to said border frame; and an angular adjustment locker provided at an outer side of said joint seat in a rotatably movable manner to securely lock up said supporting shaft within said adjustment sleeve in a rotatably movable manner for retaining an alignment of said glass structure in position with respect to said border frame so as to pivotally mount said glass structure to said border frame.

2. The pivot hinge, as recited in claim 1, wherein said angular adjustment locker comprises at least a locking member and has an adjustment slit longitudinally formed on said joint seat to communicate with said adjustment sleeve and at least a locking hole transversely formed on said outer side of said joint seat though said adjustment slit, wherein said locking member is rotatably engaged with said locking hole to adjustably reduce a width of said adjustment slit so as to lock up said adjusting portion of said supporting shaft within said adjustment sleeve.

3. The pivot hinge, as recited in claim 2, wherein said joint seat further has a frame mounting surface for mounting on said border frame and comprises a leveling platform integrally extended from a mid-portion of said frame mounting surface and a level adjusting member, having same thickness of said leveling platform, detachably mounted on a side of said leveling platform to level said frame mounting surface.

4. The pivot hinge, as recited in claim 2, further comprising a reinforcing member adapted for mounting on a frame track of said border frame to strengthen said frame track by increasing a thickness thereof, wherein said joint seat is securely mounted to said reinforcing member for substantially sandwiching said frame track therebetween so as to rigidly mount said joint seat to said border frame.

5. The pivot hinge, as recited in claim 2, wherein each of said joint walls, having a U-shaped, defines an accessing cavity to communicate with said joint seat, wherein said joint seat, having a T-shaped, comprises a central platform defining said adjustment sleeve thereon and two side platforms for securely attaching to said border frame, wherein said central platform is disposed within said accessing cavity of said joint body to rotatably engage said adjusting portion of said supporting shaft with said adjustment sleeve.

6. The pivot hinge, as recited in claim 5, wherein said adjustment slit is longitudinally formed along said central platform of said joint seat across said adjustment sleeve and said locking hole is transversely formed on said outer side of said central platform through said adjustment slit such that a size of said adjustment sleeve is substantially reduce to frictionally lock up said adjusting portion of said supporting shaft when said locking member is rotatably engaged with said locking hole to reduce said width of said adjustment slit.

7. The pivot hinge, as recited in claim 2, wherein said adjusting portion of said supporting shaft is constructed to have a cog-liked cross section to frictionally engage with said adjustment sleeve, so as to ensure said supporting shaft locking up with said joint seat.

8. The pivot hinge, as recited in claim 7, wherein each of said joint walls, having a U-shaped, defines an accessing cavity to communicate with said joint seat, wherein said joint seat, having a T-shaped, comprises a central platform defining said adjustment sleeve thereon and two side platforms for securely attaching to said border frame, wherein said central platform is disposed within said accessing cavity of said joint body to rotatably engage said adjusting portion of said supporting shaft with said adjustment sleeve.

9. The pivot hinge, as recited in claim 8, wherein said joint seat further has a frame mounting surface for mounting on said border frame and comprises a leveling platform integrally extended from a mid-portion of said frame mounting surface and a level adjusting member, having same thickness of said leveling platform, detachably mounted on a side of said leveling platform to level said frame mounting surface.

10. The pivot hinge, as recited in claim 8, further comprising a reinforcing member adapted for mounting on a frame track of said border frame to strengthen said frame track by increasing a thickness thereof, wherein said joint seat is securely mounted to said reinforcing member for substantially sandwiching said frame track therebetween so as to rigidly mount said joint seat to said border frame.

11. The pivot hinge, as recited in claim 8, wherein said adjustment slit is longitudinally formed along said central platform of said joint seat across said adjustment sleeve and said locking hole is transversely formed on said outer side of said central platform through said adjustment slit such that a size of said adjustment sleeve is substantially reduce to frictionally lock up said adjusting portion of said supporting shaft when said locking member is rotatably engaged with said locking hole to reduce said width of said adjustment slit.

12. The pivot hinge, as recited in claim 11, further comprising a reinforcing member adapted for mounting on a frame track of said border frame to strengthen said frame track by increasing a thickness thereof, wherein said joint seat is securely mounted to said reinforcing member for substantially sandwiching said frame track therebetween so as to rigidly mount said joint seat to said border frame.

13. The pivot hinge, as recited in claim 11, wherein said joint housing, which is securely mounted between said joint walls, has an axial sleeve to rotatably receive said control portion of said supporting shaft and at least two radial slots radially extended to communicate with said axial sleeve, wherein said joint housing further comprises at least two ball-shaped driving members rotatably disposed within said radial slots respectively to ensure said supporting shaft in a rotatably movable manner within said axial sleeve.

14. The pivot hinge, as recited in claim 11, wherein said joint seat further has a frame mounting surface for mounting on said border frame and comprises a leveling platform integrally extended from a mid-portion of said frame mounting surface and a level adjusting member, having same thickness of said leveling platform, detachably mounted on a side of said leveling platform to level said frame mounting surface.

15. The pivot hinge, as recited in claim 14, wherein said joint housing, which is securely mounted between said joint walls, has an axial sleeve to rotatably receive said control portion of said supporting shaft and at least two radial slots radially extended to communicate with said axial sleeve, wherein said joint housing further comprises at least two ball-shaped driving members rotatably disposed within said radial slots respectively to ensure said supporting shaft in a rotatably movable manner within said axial sleeve.

16. The pivot hinge, as recited in claim 14, further comprising a reinforcing member adapted for mounting on a frame track of said border frame to strengthen said frame track by increasing a thickness thereof, wherein said joint seat is securely mounted to said reinforcing member for substantially sandwiching said frame track therebetween so as to rigidly mount said joint seat to said border frame.

17. The pivot hinge, as recited in claim 16, wherein said joint housing, which is securely mounted between said joint walls, has an axial sleeve to rotatably receive said control portion of said supporting shaft and at least two radial slots radially extended to communicate with said axial sleeve, wherein said joint housing further comprises at least two ball-shaped driving members rotatably disposed within said radial slots respectively to ensure said supporting shaft in a rotatably movable manner within said axial sleeve.

18. The pivot hinge, as recited in claim 1, wherein each of said joint walls, having a U-shaped, defines an accessing cavity to communicate with said joint seat, wherein said joint seat, having a T-shaped, comprises a central platform defining said adjustment sleeve thereon and two side platforms for securely attaching to said border frame, wherein said central platform is disposed within said accessing cavity of said joint body to rotatably engage said adjusting portion of said supporting shaft with said adjustment sleeve.

19. The pivot hinge, as recited in claim 18, wherein an adjustment slit is longitudinally formed along said central platform of said joint seat across said adjustment sleeve and said locking hole is transversely formed on said outer side of said central platform through said adjustment slit such that a size of said adjustment sleeve is substantially reduce to frictionally lock up said adjusting portion of said supporting shaft when said locking member is rotatably engaged with said locking hole to reduce said width of said adjustment slit.

20. The pivot hinge, as recited in claim 1, wherein said joint seat further has a frame mounting surface for mounting on said border frame and comprises a leveling platform integrally extended from a mid-portion of said frame mounting surface and a level adjusting member, having same thickness of said leveling platform, detachably mounted on a side of said leveling platform to level said frame mounting surface.

* * * * *